United States Patent [19]

Spaderna

[11] 4,249,045

[45] Feb. 3, 1981

[54] SELECTOR SWITCH

[76] Inventor: Conan H. Spaderna, 39 Biltmore St., Springfield, Mass. 01108

[21] Appl. No.: 15,187

[22] Filed: Feb. 26, 1979

[51] Int. Cl.[3] ..... H01H 21/54

[52] U.S. Cl. ..... 200/15; 200/153 H; 200/162; 200/18

[58] Field of Search ..... 200/5 B, 153 H, 153 J, 200/164 A, 249, 251, 254, 1 A, 1 B, 15, 18, 6 R, 9, 6 BA, 5 A, 162

[56] References Cited

U.S. PATENT DOCUMENTS

| | | | |
|---|---|---|---|
| 996,336 | 6/1911 | Hill | 200/15 |
| 2,291,517 | 7/1942 | Wolff | 200/15 |
| 2,649,512 | 8/1953 | Streuer et al. | 200/6 R |
| 3,467,922 | 9/1969 | Greenwall, Jr. et al. | 200/18 |
| 4,128,749 | 12/1978 | Spaderna | 200/254 |

*Primary Examiner*—Willis Little

[57] ABSTRACT

The present switch has a main switch lever so pivoted in the trough of an insulating housing, that the lever plays in a path, slightly deviating from the troughway. This assures contact pressure between the conducting lever and fixed contacts along the troughway. A conducting gate switch lever is designed for making and breaking the feeding connection between an electrical source and the main lever. With the gate lever "off", the main lever may pass along a row of fixed contacts without any effect, until the selected contact is reached. Then, the gate lever may be energized by making connection with the source; thus a piece of equipment is fed over the selected fixed contact. The present switch safely handles, unlike a rotating switch, ionized gases, because these gases do not drift by several contacts on their way out. No unwanted electrical bridging to other than the selected pieces of equipment will occur. The selector switch may be used for interconnection of telephones, as a translator aid, or for selective command of machine tools in automated production processes.

8 Claims, 15 Drawing Figures

SELECTOR SWITCH

BACKGROUND OF THE INVENTION

The selector switch has a conducting main lever, playing in a trough, similar to the latching switch, U.S. Pat. No. 4,128,749, with an open upward escape for ionized gas, which is brought about by arcing at any contact position of the switch. However, the selector switch has no single built-in sequence of connections, to be made and broken in feeding and disconnecting pieces of equipment. Instead, the present switch picks up a desired contact or a combination of contacts directly.

Existing lever switches allow stopping of the lever only in the two end positions of a lever run by lever catching contacts, shaped like receptacles, open only to one side, like a wedge hold. Contacts, fixed inbetween those end positions, cannot be massproduced with sufficient accuracy, to hold the lever, yet to let it pass through under increased forward pressure. Protruding parts of such contacts would stop the lever.

It has been proposed, to have in a latching switch (U.S. Pat. No. 4,128,749) a small built-in deviation of the lever run against its insulating trough way. However, on a very long trough way with many fixed contacts, at the ends of the lever run the latching bias may be excessive. The present selector switch uses a metallic main lever, long enough, to bend away from the contact lugs on its path for passing by. In order to pick up only one selected contact, a gate lever is designed. It can disconnect the pivot of the main lever, which pivot is built as a terminal, from the electrical source, while the main lever is being moved to a selected contact position.

When this position is reached, the operator closes the gate switch. A piece of equipment, connected permanently to the contact lug, against which the lever is resting with its conductive metal, receives current. The gate switch is designed to break contact under full load. For convenience, the gate switch is arranged in one corner of the lever run it is serving. Several parallel lever runs may be served at the same time.

The selector switch would not be fully operational without special fixed contacts, allowing in the confines of the trough a delicate adjustment of their free ends, without loosening the attachment of wires to the binding screws, screwed into the fixed contacts; their design and operation is described with reference to the drawing.

The invention is illustrated in the drawing, but not limited to the given examples, as substitutions for the conventional parts would not alter the spirit of the invention. Thus, locating the gate switch outside the housing of the selector switch would still fall within the general scope of the invention.

Figures 1, 2, 3, 4, 5, 6, 7, 8, 9, 10, 11:
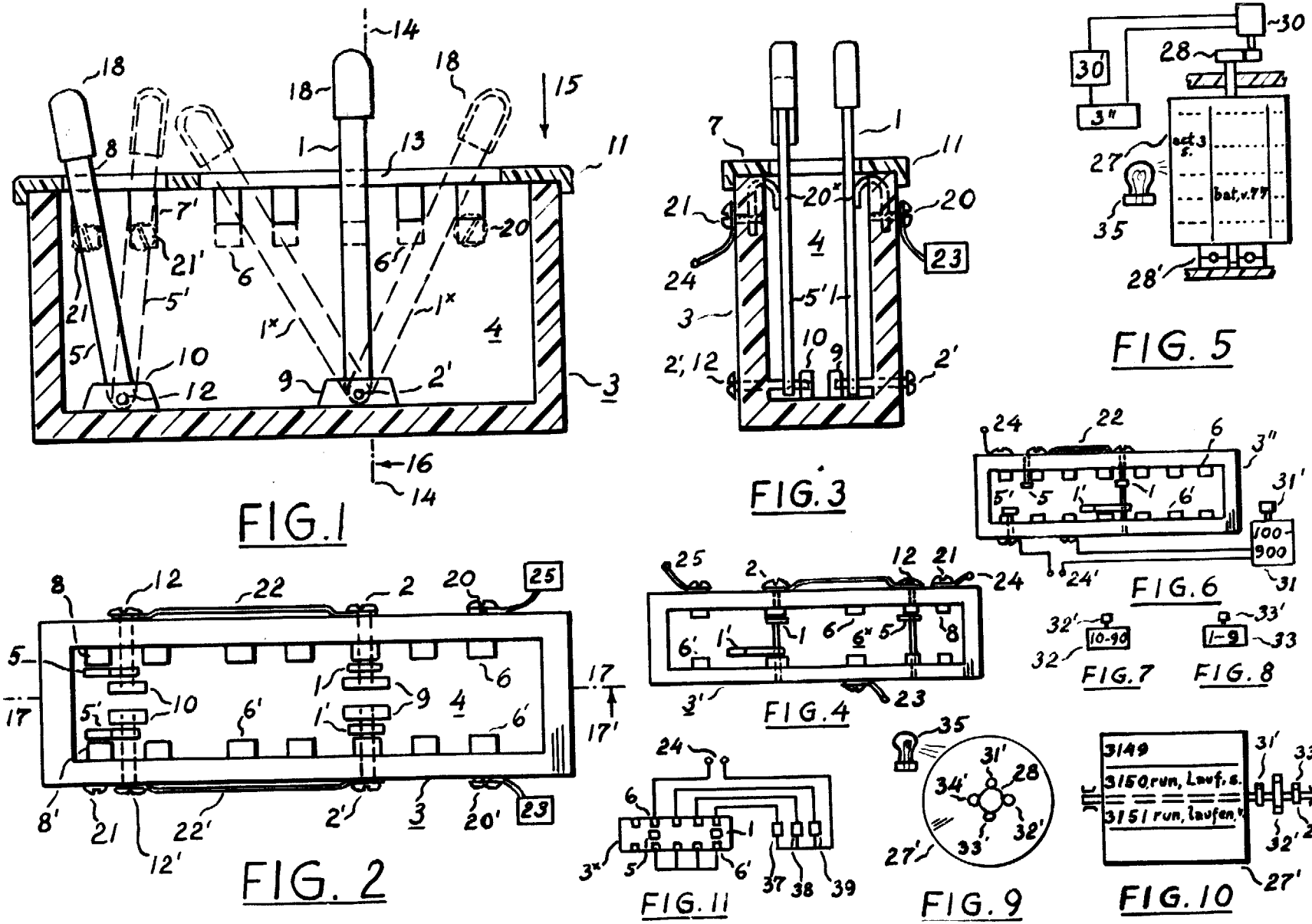
FIG. 1 is an elevated view of the new switch in section 17—17 of FIG. 2, seen along the arrow 17'.
FIG. 2 is a top view of the same switch, seen along the arrow 15.
FIG. 3 is a side view of the switch in section 14—14 of FIG. 1, seen along arrow 16.
FIG. 4 is a top view of a similar switch, however with only one gate switch lever for two rows of fixed contacts.
FIG. 5 shows the basic design of a translator cylinder with reference numbers for words, alphabetically arranged, and step-wise rotated.
FIG. 6 is a top view of a selector switch, having ten fixed contacts, over which two main levers play, the step from one fixed contact to the next corresponding with the distance of 1000 words on the translator cylinder, if driven by a motor of a suitable gear ratio.
FIG. 7 is a schematic arrangement of a cylinder drive motor, answering a step of the main lever between two fixed contacts with a rotation, corresponding to the distance of ten words on a cylinder.
FIG. 8 is a cylinder drive motor, similar to FIG. 7, yet producing steps of the distance between two neighboring words on the translator cylinder, that keeps a regular distance between words.
FIG. 9 is an end view of a translator cylinder, seen along arrow 36, showing the arrangement of driving pinions around a tooth wheel, fixed on the cylinder shaft, including a pinion for the return run.
FIG. 10 is an elevated view of the cylinder and its pinions, also showing an example of word display, according to reference numbers.
Figure 13:
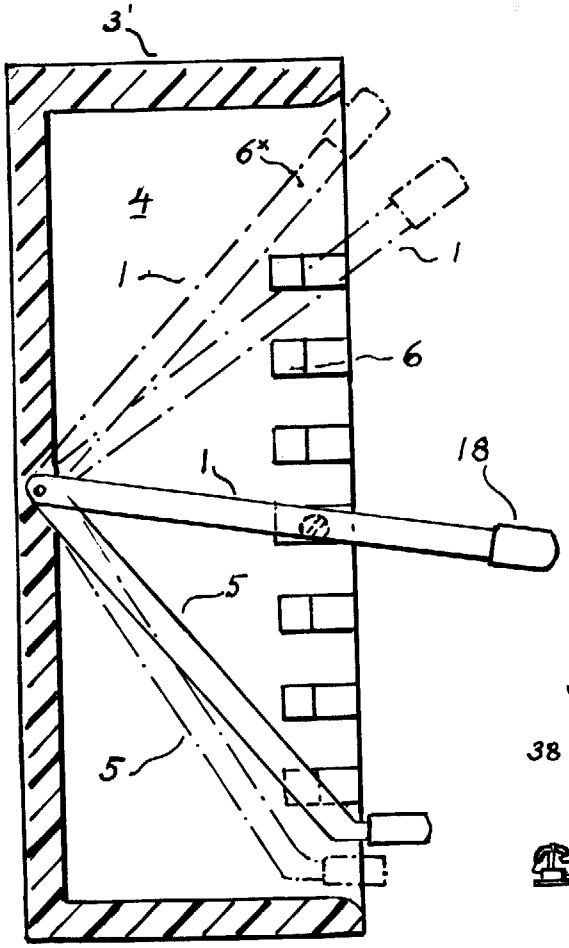
Figure 12:
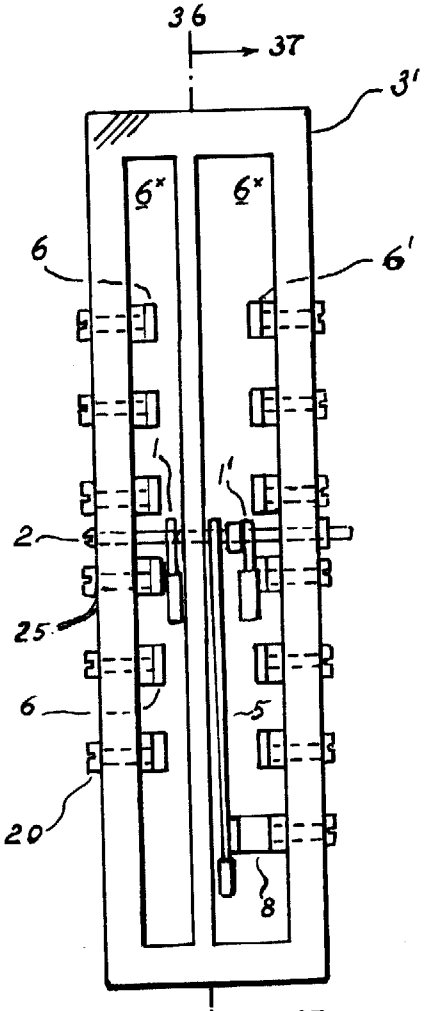

FIG. 11 is a schematic arrangement of a selector switch, commanding the start and stoppage of tools in industrial automation, used singly or in groups. FIGS. 12, 13 show suitable dimensional relations for selector switches. Reference numbers are in keeping with reference numbers shown elsewhere, and easily found on FIGS. 1-4.

FIG. 12 is a top view of a selector switch with six fixed contacts for the main lever.

FIG. 13 is an elevated view of the same switch, seen in cross section through line 36—36, and along arrows 37 of FIG. 12.

Figure 14:
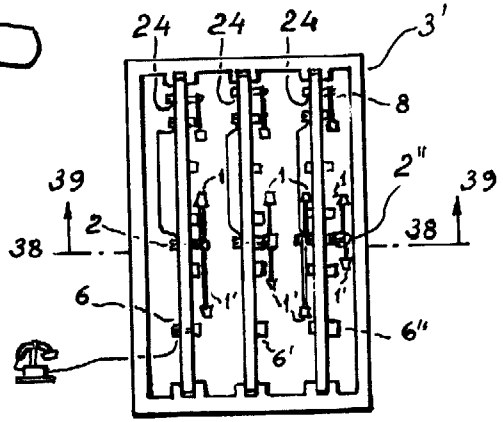

FIG. 14 shows a schematic top view on a reduced scale of a house exchange box for intercommunication with slide-in trough walls. This system makes possible conferences of several participants by telephone.

Figure 15:
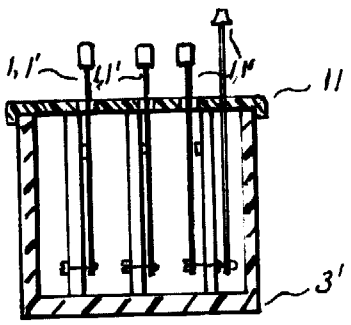

FIG. 15 shows a schematic side view of the same house exchange in section through line 38—38 of FIG. 14, seen along arrows 39.

Reference numbers 14, 15 indicate the same parts as in other FIGS.

GENERAL DESCRIPTION OF THE SWITCH

In FIGS. 1 and 2 a metallic main lever 1, pivoted by a screw pin 2, and another main lever 1', pivoted by a screw pin 2', play inside an insulated housing 3. The housing is molded with a trough 4, formed in its middle. The trough is studded with fixed contacts 6 on one side, and with fixed contacts 6' on the other side. An operator may push the main levers into their outermost positions 1*, touching the fixed contacts on their way, which deviates slightly from the trough way; thus the main levers obtain a side pressure against the fixed contacts.

Playing between fixed contacts 7 and 8, a gate switch lever 5 makes and breaks connection between an electric source terminal 24 and the screw pin 12; this connection is best seen on the left side of FIG. 3. From the screw pin 12 a wire 22 (FIG. 2) runs to the screw pin 2, which in turn feeds the row of fixed contacts 6, if its upper blades 20* press against the main lever 1. Thus, for example, a binding screw 20 feeds a piece of equipment 25.

Between fixed contacts 7' and 8' a gate switch lever 5' can in the same way make or break connection between its screw pin 12' and an electric source terminal 24. From the pin 12' a wire 22' runs to the screw pin 2', (FIG. 2) which in turn feeds one of the fixed contacts 6', if its upper blade 20* makes contact with the main lever 1'. Thus, a piece of equipment, for example 23, is fed over a binding screw 20'.

This design of main- and gate switch levers enables the operator, to select directly single pieces of equipment for feeding. On the bottom of the trough 4, molded lugs 9 give one-sided support to the screw pins 2, 2' and molded lugs 10 give support to the screw pins 12, 12'. A lid 11 of the housing has a slot 13, through which insulating handles 18 of the levers 1 and 5 stick out for safe use by the operator.

The crucial adjustment of the fixed contacts would not be possible, if their binding screws were not free to screw in and out of the molded-in fixed contacts, for example 6' in FIG. 3, without touching the upper blade 20* of the fixed contact. The position of the blade 20* would be affected also by loosening such a touch. Therefore, a special shape of the fixed contact, and the possibility of adjusting the upper blade in the narrow confines of the trough by a pair of pliers are essential for the operation of the selector switch. Also, the upper blade must be free from the molded wall of the housing 3, so that a lever can open up a passage beside the blade by bending it elastically a little closer toward the wall. Then it can snap back into its position, allowing good contact with a lever. The blade 20* may be bent downward or upward.

A SPECIAL SELECTOR SWITCH FOR INTERCOMMUNICATION

In FIG. 4 most reference numbers correspond with the reference numbers in FIGS. 1-3. A selector switch 3' for intercommunication in buildings, ships or airplanes is operated by two main levers 1, 1', serving rows of fixed contacts 6, 6'. The levers have a common pivot pin or two connected pins. Only one gate switch lever 5 is needed for operation of this switch, which has three fixed contacts in each row. Empty space 6* between each pair of neighboring contacts affords the main levers "off" positions, as shown. It is the same, as if each second fixed contact in FIG. 2 were left out.

The operator wants to ring up a telephone, having a terminal 6, he puts the gate switch lever on the right hand side in "off" position, as shown. Then he moves the main lever 1 into contact with a fixed contact 6, but leaves the lever for fixed contacts 6' in an off position, as shown. By making contact between the lever 5 and the contact 8, he rings up the telephone, connected to a fixed contact 6.

The present arrangement of six telephones and two main levers offers another, unique advantage. Instead of calling only one telephone, he may call two, three, four, five, or all six telephones of the selector set, to participate in a blind conference. He simply puts a group of telephones into parallel reception, before throwing the gateswitch lever "on". This has obvious advantages for a busy manager, who needs opinions and information quick from several persons of his staff.

A SPECIAL SELECTOR SWITCH FOR LANGUAGE TRANSLATION

The FIGS. 5-10 deal with an application of the selector switch to semi-automatic translation with the help of small motors. It is convenient, to correlate words in dictionaries for several languages, if having the same meaning, with the same reference numbers. However, these words, and/or their reference numbers must still be looked up, which is time consuming.

In FIG. 5 a way is shown, how to find a reference number for a given word, whereas FIGS. 6-9 illustrate means for finding a word or familiar saying in another language by its reference number. In FIG. 5 a cylinder 27, rotatable under a bulb 35, carries words in alphabetical order and their reference numbers. For example, "bat, v. 77" is a verb. The vertical cylinder rests upon a ball bearing 28', and is turned stepwise by a motor 30, receiving impulses, directed to the motor from a known impulse generator 30' by a selector switch 3''. 29, 28 is a reduction gear, needed for adaption to cylinders of different step size.

In FIG. 6 a selector switch 3'' has a main lever 1, serving five fixed contacts 6'; gate switch levers 5, 5' switch on these rows of contacts, after the main levers have been set for the wanted connection with a motor 31, 32, or 33, turning pinions 31'', 32'' or 33''. The pinion 34'' for backward run is turned by a special motor. All pinions mesh with a tooth wheel 28, which is fastened to the shaft of cylinder 27. This cylinder displays rising reference numbers beside words in at least one language. It helps a translator to find or verify translation. (FIGS. 9, 10) The words are not in alphabetical order if only a close relationship in meaning is indicated, as in "required, demanded". The operator may get the reference numbers from the cylinder of FIG. 5. The translator set will help prepare a translation from or into a foreign language.

A selector switch 3'' will be arranged for each cylinder, say for reference numbers 1-1000, 1001-2000, 2001-3000 and so forth. If more languages are shown in the horizontal lines, it may be necessary, to have smaller cylinders with, say, 250 numbers each.

A SELECTOR SWITCH FOR AUTOMATED INDUSTRIAL PRODUCTION

FIG. 11 is a schematic example for application of the selector switch to industrial automation. A selector switch 3* has besides a gate switch lever 5 a main lever 1, ready to bridge fixed contacts 6 and 6', thus completing circuits from a source 24 through pieses of equipment 37-39 and back to the source. Selective switching allows to use some tools, without having the others idling, which saves energy. Also headstart or testing of single tools is possible.

I claim:

1. A selector switch, comprising a housing of insulating material, a trough, formed inside the housing of insulating material and studded with fixed terminal-type contacts, separately connected with pieces of equipment for their feeding from an electrical source; at least one conducting main lever, designed for selectively latching with the contacts, and having an insulating handle, the main lever having a pivot pin, extending through one end thereof so as to allow the lever to pivot in the trough with a small deviation of the runway against the troughway thereof, and further comprising a gate switch lever with a pivot pin extending through one end thereof and electrically connected to the pivot pin of the main lever via a wire extending therebetween, and a separate fixed contact mounted in said housing and extending into the troughway adjacent the pathway of said gate switch lever for allowing the gate switch lever to make and break a feeding connection between the electrical source connected to the separate fixed contact and the wire running to the pivot pin of the main lever.

2. A selector switch as set forth in claim 1, comprising fixed contacts, having a base and a free end, a binding screw screwed into the base, which base is bowed around the rim of the trough wall, and having the free end bent into the troughway, leaving enough free space for the binding screw to be screwed in and out, without disturbing the lever contact, and allowing adjustment of the free blade end by bending.

3. A selector switch, as set forth in claim 1, comprising several main levers and a gate switch lever for switching the electrical source to and off the pivot pin of the gate switch lever, which serves also as the common pivot of all main levers, and further having for every main lever in its row of fixed contacts at least one neutral waiting position.

4. A selector switch, as set forth in claim 1, having several main levers, each serving a separate row of fixed contacts, the switch also having a gate switch lever for every row, which lever, if open, allows inoperative setting movement of its co-ordinated main lever in preparation of feeding a piece of equipment.

5. A selector switch, as set forth in claim 1, wherein the main levers are switching on and off motors, which turn cylinders, displaying lists of words with selected initial letters and correlated reference numbers of a sought word translation, the switch contacts having digits, related to the order numbers of cylinders, and to the line and column in which the word is displayed on a cylinder.

6. A selector switch, as set forth in claim 1, utilized for a system of intercommunication by telephones with the switch contacts having associated digits for telephones, that may be selectively connected in parallel by the switch.

7. A selector switch, as set forth in claim 1, wherein the main levers switch on and off motors, carrying out processing steps, such as positioning and machining of a work piece.

8. A selector switch, as set forth in claim 1, wherein a main lever is designed to electrically bridge between contacts, arranged on opposite sides of the trough, the contacts on one side being linked to the electrical source, the contacts on the other side being linked to pieces of equipment.

* * * * *